US010104945B2

(12) United States Patent
Bauer

(10) Patent No.: US 10,104,945 B2
(45) Date of Patent: Oct. 23, 2018

(54) CANTILEVERED UMBRELLA DESIGN WITH AN ARCUATE GUIDE TRACK

(71) Applicant: Resort Umbrella Solutions LLC, St. Charles, IL (US)

(72) Inventor: Richard Bauer, Palatine, IL (US)

(73) Assignee: Resort Umbrella Solutions LLC, St. Charles, IL (US)

( * ) Notice: Subject to any disclaimer, the term of this patent is extended or adjusted under 35 U.S.C. 154(b) by 0 days.

(21) Appl. No.: 15/629,944

(22) Filed: Jun. 22, 2017

(65) Prior Publication Data

US 2017/0367447 A1 Dec. 28, 2017

Related U.S. Application Data

(60) Provisional application No. 62/353,087, filed on Jun. 22, 2016.

(51) Int. Cl.
*A45B 23/00* (2006.01)
*A45B 17/00* (2006.01)

(52) U.S. Cl.
CPC ..... *A45B 23/00* (2013.01); *A45B 17/00* (2013.01); *A45B 2023/0037* (2013.01); *A45B 2023/0075* (2013.01); *A45B 2023/0081* (2013.01)

(58) Field of Classification Search
None
See application file for complete search history.

(56) References Cited

U.S. PATENT DOCUMENTS 4,586,525 A 5/1986 Glatz
5,678,585 A * 10/1997 May ..... A45B 23/00 135/20.1
5,785,069 A * 7/1998 Glatz ..... A45B 23/00 135/20.1
6,014,980 A * 1/2000 Glatz ..... A45B 17/00 135/20.1
6,401,739 B1 * 6/2002 Bright ..... A45B 23/00 135/98
6,435,444 B1 8/2002 Lin
6,478,037 B2 * 11/2002 Tung ..... A45B 23/00 135/20.1
6,926,019 B2 8/2005 Glatz
(Continued)

FOREIGN PATENT DOCUMENTS

CN 201712715 U 1/2011
CN 202858065 U 4/2013
CN 203952666 U 11/2014

*Primary Examiner* — Winnie Yip
(74) *Attorney, Agent, or Firm* — Law Office of Kurt J. Fugman LLC

(57) ABSTRACT

A cantilevered umbrella assembly with an arcuate guide track comprises a support column, a cantilever arm attached to the support column, and an at least partially arcuate configured guide track attached to the cantilever arm that defines a sweep axis and a plane. The guide track defines a first free end, a second free end and an apex between the first end and the second end along the sweep axis. The sweep axis defines a first tangent to the sweep axis at the first end, a second tangent at the second end, and a third tangent at the apex, wherein a first line drawn perpendicularly to the first tangent and a second line drawn perpendicularly to the third tangent form a first included angle in the plane of the guide track that ranges from 10 to 45 degrees.

27 Claims, 8 Drawing Sheets

(56) References Cited

U.S. PATENT DOCUMENTS

| | | | | |
|---|---|---|---|---|
| 6,988,504 | B1 | 1/2006 | Goldwitz | |
| 7,134,442 | B2 * | 11/2006 | Ma | A45B 19/04 135/20.1 |
| 7,314,055 | B2 * | 1/2008 | Guo | E04H 15/28 135/156 |
| 7,980,261 | B2 * | 7/2011 | Glatz | A45B 19/04 135/20.1 |
| 8,113,223 | B2 * | 2/2012 | Wang | A45B 19/04 135/20.1 |
| 8,985,129 | B2 * | 3/2015 | Li | A45B 17/00 135/20.1 |
| 9,204,695 | B2 * | 12/2015 | Van Loosbroek | A45B 19/00 |
| 2007/0209688 | A1 * | 9/2007 | Earnshaw | A45B 23/00 135/16 |
| 2013/0333734 | A1 | 12/2013 | Ma | |

* cited by examiner

CANTILEVERED UMBRELLA DESIGN WITH AN ARCUATE GUIDE TRACK

PRIORITY CLAIM

The present application is a Non-Provisional of U.S. Provisional Patent Application Ser. No. 62/353,087, entitled Cantilevered Umbrella Design with an Arcuate Guide Track, filed on Jun. 22, 2016, claiming priority thereto and which is hereby incorporated by reference for all purposes in its entirety.

TECHNICAL FIELD

The present disclosure relates to cantilevered umbrella assemblies that have movable umbrella assemblies attached thereto. More particularly, the present disclosure is related to a cantilevered umbrella design that uses an arcuate shaped guide track.

BACKGROUND

Many hotels, resorts and the like provide cantilevered umbrellas that provide shade from the sun for their patrons. This is particularly common near coastal and warm areas so that patrons may enjoy the weather comfortably. Currently, cantilevered umbrellas provide canopies that have a limited ability to adjust their angle with respect to the sun. For example, the umbrella is often most effective when blocking the sun when it is located on the side opposite of the support column as compared to the cantilever arm to which the canopy is attached. Eventually, once the sun hits its zenith, the effectiveness of the canopy to provide suitable shade is limited.

Often, patrons are forced to move their belongings to other areas now effectively shaded, to go indoors, or to leave the venue altogether. This may lead to lost revenues or patron dissatisfaction.

Furthermore, the setup of areas near swimming pools and the like may change at a venue over time. This may make it necessary to change the location of tables, lounging chairs, etc. Many cantilevered umbrella designs do not effectively provide for adjusting the shade provided by them to easily and inexpensively accommodate such changes in the venue.

SUMMARY OF THE DISCLOSURE

A cantilevered umbrella assembly with an arcuate guide track is provided that comprises a support column, a cantilever arm attached to the support column, and an at least partially arcuate configured guide track attached to the cantilever arm that defines a sweep axis and a plane. The guide track defines a first end, a second end and an apex between the first end and the second end along the sweep axis. A guide slot extends from the first end to the second end. The sweep axis defines a first tangent to the sweep axis at the first end, a second tangent at the second end, and a third tangent at the apex, wherein a first line drawn perpendicularly to the first tangent and a second line drawn perpendicularly to the third tangent form an included angle in the plane of the guide track that ranges from 10 to 45 degrees.

A cantilevered umbrella assembly with an arcuate guide track is provided comprising a support column, a cantilever arm attached to the support column, an at least partially arcuate configured guide track attached to the cantilever arm that remains at least selectively fixed in position relative to the support column and cantilever arm, the guide track defining a first free end and a second free end, and an umbrella subassembly that is translatably attached to the guide track and is configured to slide from the first end of the guide track to the second end of the guide track in an expanded state without collapsing without moving the cantilever arm.

A cantilevered umbrella assembly with a guide track is provided comprising a support column, a cantilever arm attached to the support column, a guide track attached to the cantilever arm that remains at least selectively fixed in position relative to the support column and the cantilever arm. The guide track defines a first free end, a second free end, a top surface, a bottom surface, a first side surface and a second side surface wherein the first side surface defines a first guide slot and the second side surface defines a second guide slot. The umbrella assembly further comprises a carriage assembly the includes a slide bracket that includes a first inside side surface and a second inside side surface, a first roller extending from the first inside side surface that is rotatably attached thereto, and a second roller extending from the second inside side surface that is rotatably attached thereto. The first roller is disposed in the first guide slot and the second roller is disposed in the second guide slot.

An umbrella subassembly for use with an umbrella assembly is provided comprising an umbrella attachment mechanism having a locking member and a release cord. The subassembly comprises a canopy, an articulated support structure to which the canopy is attached, and an upward extending attachment member that defines at least one hole that is configured to receive the locking member.

A method of assembling and using an umbrella assembly is provided comprising attaching a support column to an immovable structure, attaching a cantilever arm to the support column, attaching a guide track to the cantilever arm, attaching an umbrella subassembly to the guide track in a slidable manner, sliding the umbrella subassembly along or using the guide track with the canopy in an expanded state along an arcuate path, and fixing the position of the umbrella subassembly relative to the guide track and cantilever arm.

DETAILED DESCRIPTION

Figure 1:
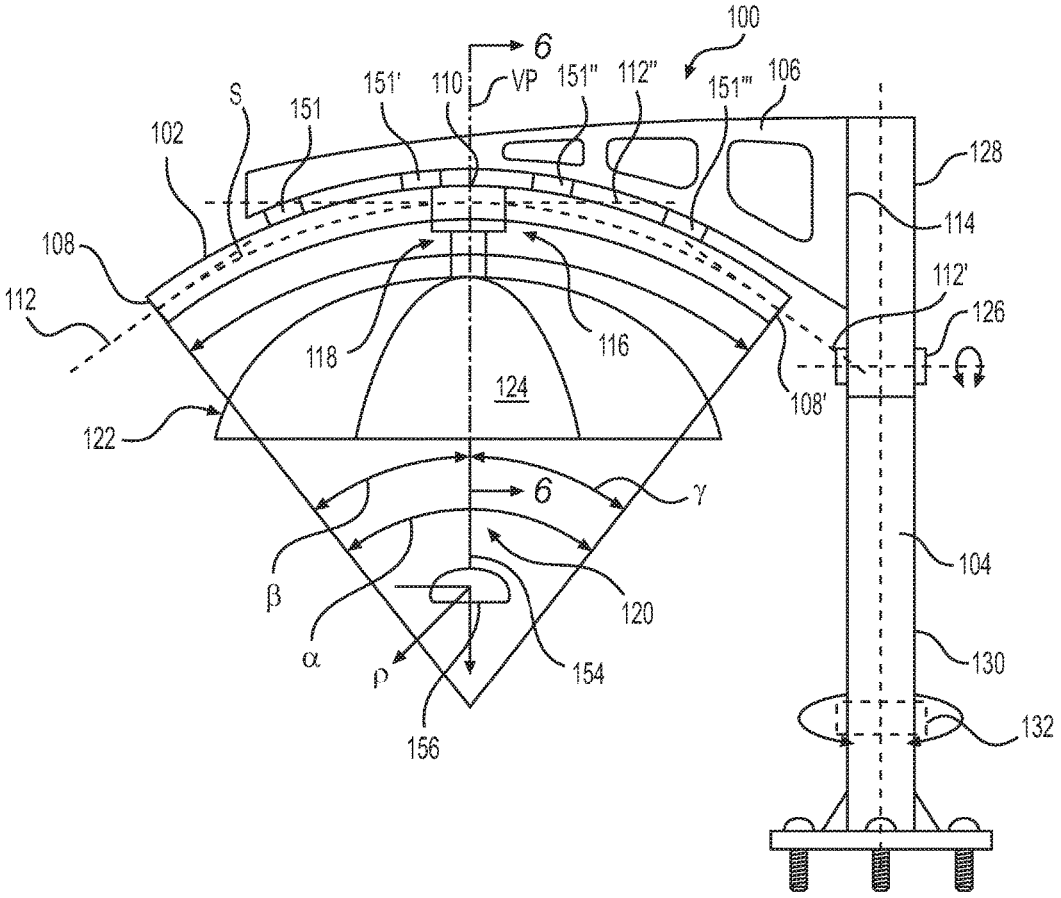
FIG. 1 is a front view of a cantilevered umbrella assembly using an arcuate guide track according to an embodiment of the present disclosure with the umbrella subassembly and canopy shown in a middle position relative to the guide track.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

This disclosure provides a cantilevered umbrella assembly that uses an arcuate guide track that allows the canopy to be positioned relative to the sun all day long and still provide effective shade. The umbrella assembly may also be provided with joints that allow the support column to move about a vertical axis and a horizontal axis to further adjust the area shaded by the canopy.

FIG. 1 illustrates a cantilevered umbrella assembly 100 with an arcuate guide track 102 comprising a support column 104, a cantilever arm 106 attached to the support column 104, and at least a partially arcuate configured guide track 102 attached to the cantilever arm 106 that defines a sweep axis S and a plane P102 (shown as a vertical plane in FIG. 2), wherein the guide track 102 defines a first free end 108, a second free end 108' and an apex 110 between the first end 108 and the second end 108' along the sweep axis S. As shown, the sweep axis S defines a first tangent 112 to the sweep axis S at the first end 108, a second tangent 112' at the second end 108', and a third tangent 112" at the apex 110, wherein a first line drawn perpendicularly to the first tangent 112 and a second line drawn perpendicularly to the third tangent 112' forms a first included angle β in the plane P102 of the guide track 102 that ranges from 10 to 45 degrees. In some embodiments, the first included angle β ranges from about 25 to 35 degrees. In yet further embodiments, this angle β may be approximately 30 degrees. Any of the angles discussed herein may be modified as needed or desired.

The support column 104 defines a side surface 114 and the cantilever arm 106 extends from the side surface 114 of the support column 104. For this particular embodiment, the cantilever arm 106 forms an inverted "L" shape with the support column 104 and the apex 110 of the guide track defines the vertical extremity of the guide track 102. A third line drawn perpendicularly from the second tangent 112' forms a second included angle γ with the line drawn from the third tangent 112" and a third included angle γ with the line drawn from the first tangent 112, wherein the first and second included angles are within 5 degrees of each other. In some embodiments, these angles are the same, allowing the canopy to be positioned to provide proper shade at all times of the day.

In some embodiments, only a portion of the guide track such as that portion proximate the first free end, may have an arcuate shape, or the arcuate shape of the track may be present near both the first and second ends of the track with a straight portion therebeteween. As shown in the figures herein, the guide track may be completely arcuate and may in some cases may define the arc of a radius or approximate the arc of a radius. The first end will be typically a free end, but not necessarily so and the second end in some embodiments may abut or be formed integral with the support column. The lines drawn perpendicular to the tangents of the sweep axis of the guide track may also be referred to as a tangent normal.

A carriage assembly 116 that is slidably attached to the guide track 1065 may be provided that includes an umbrella attachment mechanism 118 and a position fixing mechanism 120 (only partially shown in FIG. 1). The construction and manner of operation of the umbrella attachment mechanism and the position fixing mechanism will be discussed in further detail later herein. It is contemplated that the position fixing mechanism may utilize any mechanism known or that will be devised in the art that is well suited for this purpose. Similarly, any umbrella attachment mechanism that is known or that will be devised in the art may be used that is well suited for that purpose.

Figure 3:
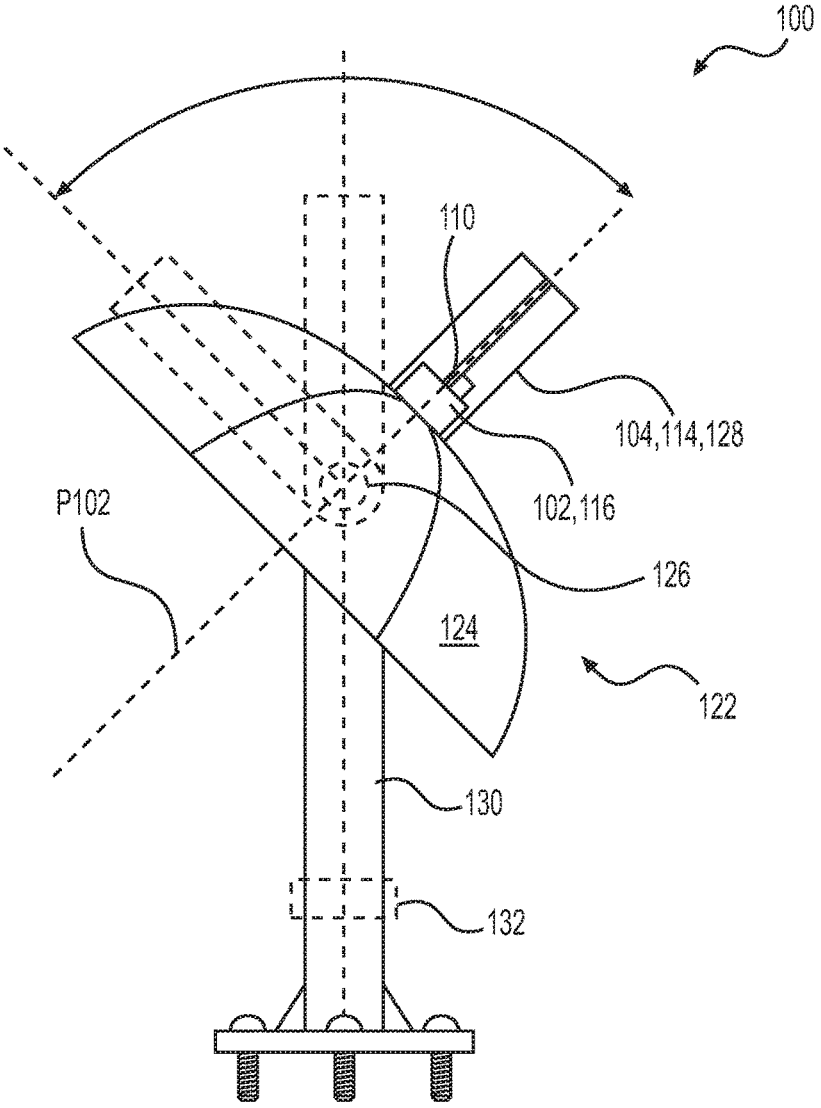
FIG. 3 is side view of the umbrella assembly of FIG. 1 showing the support column tilted about a joint oriented in the horizontal direction.
Figure 4:
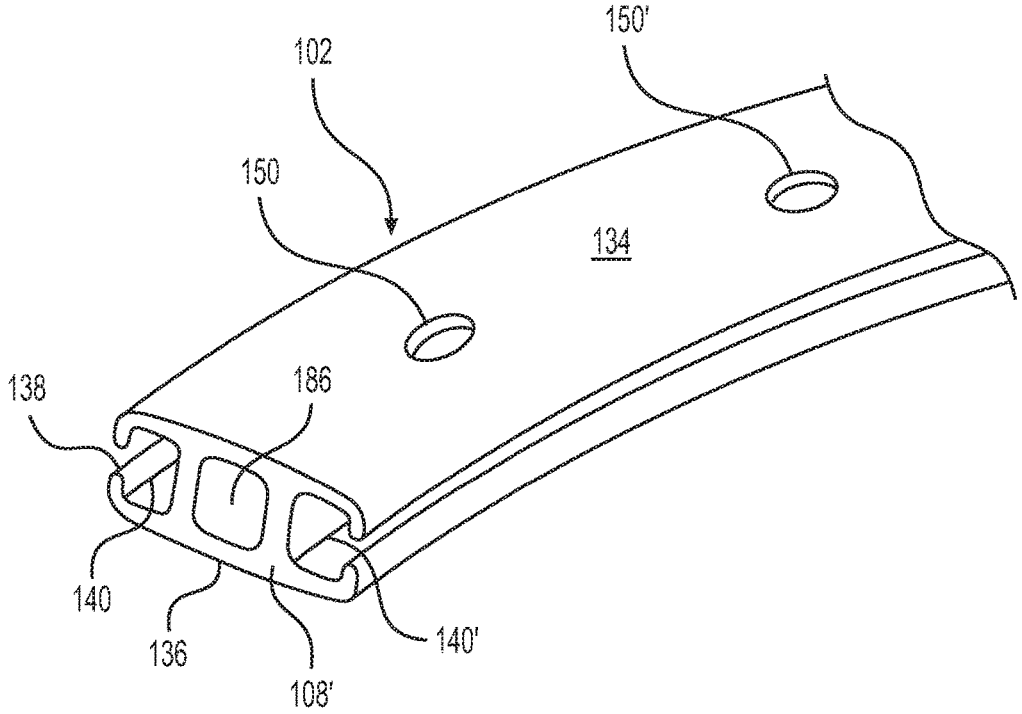
FIG. 4 is a partial top oriented perspective view of the guide track of FIG. 1.

As shown in FIGS. 1 and 3, the at least partially arcuate configured guide track 102 may be attached to the cantilever arm 106 in such a manner that the guide track 102 remains at least selectively fixed in position relative to the support column 104 and cantilever arm 106. This means that the user can fix the position of the guide track 102 so that it does not move at all relative to the arm 104 and the support column 104, even while moving the carriage assembly 116 and the umbrella subassembly 122 that is attached to the carriage assembly 116. In other embodiments, the position of the guide track 102 relative to the cantilever arm 106 and the support column 104 may be permanently fixed. As mentioned previously, the guide track 102 defines a first free end 108 and a second free end 108'. The umbrella subassembly 122 is slidably or translatably attached to the guide track 102 via the umbrella attachment mechanism 118 and is configured to slide from the first end 108 of the guide track to the second end 108' of the guide track with the canopy 124 in an expanded state without collapsing, and vice versa.

A horizontally oriented joint 126 may be provided just below the junction of the cantilever arm 106 and the support column 104, which enables the top portion 128 of the support column 104 to rotate relative to the bottom portion 130 of the support column 104 as best seen in FIG. 3. The angle formed by the top and bottom portions 128, 130 of the support column 104 may be locked using methods and devices known in the art. Another vertically oriented 132 joint using a rotary bearing (not shown) may be provided, for example, near the bottom of the support column 104 that allows the support column 104, umbrella subassembly 122, guide track 102, cantilever arm 106, etc. to rotate about a vertical axis. This may allow further adjustment to shade a desired area. Known locking mechanisms may be used to prevent movement about the vertical axis when desired. These joints may be omitted in other embodiments.

In some embodiments, the umbrella subassembly includes an expansion and collapsing mechanism for the umbrella that is separate from the fixing mechanism of the carriage assembly. In other embodiments, such an expansion and collapsing mechanism may be omitted. Alternatively, any suitable expansion and collapsing mechanism that is known or that will be devised in the art may be employed.

Figure 2:
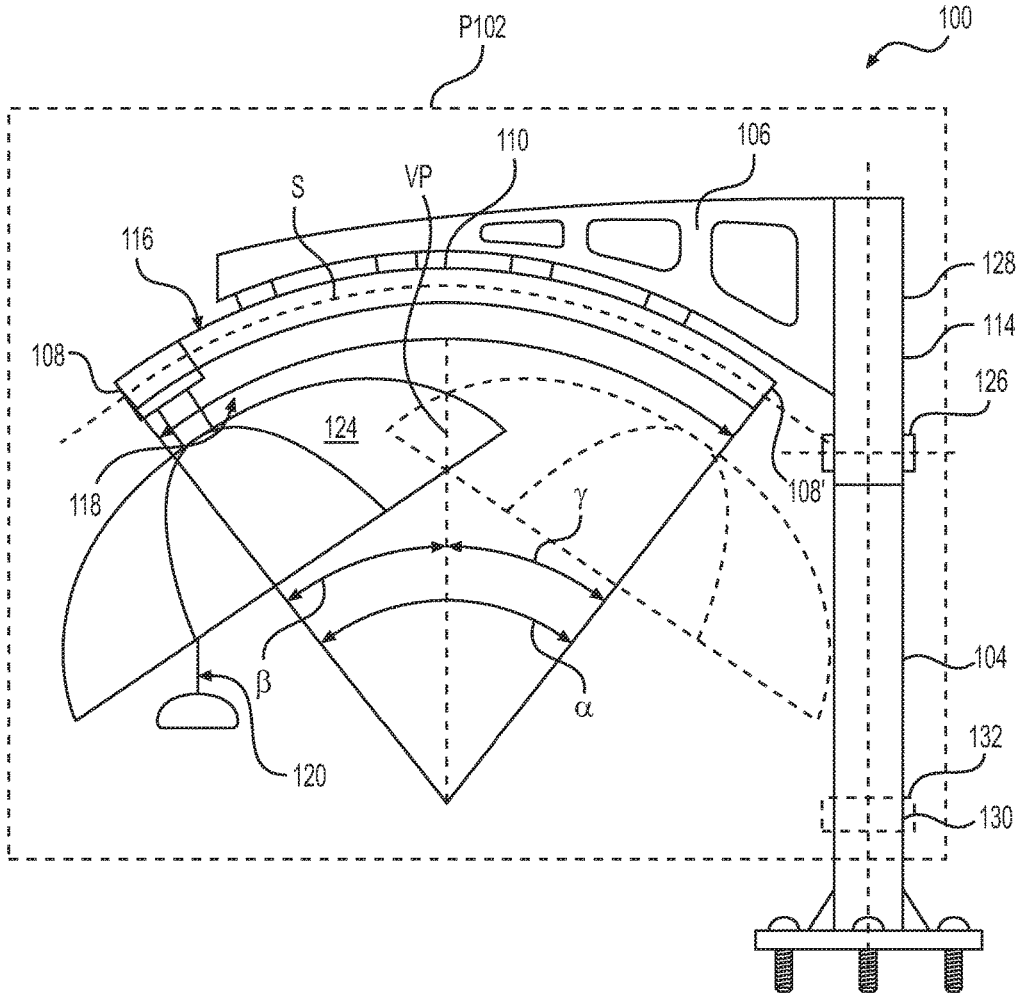
FIG. 2 illustrates the umbrella assembly of FIG. 1 with the umbrella subassembly and canopy positioned at either end of the guide track.

As depicted in FIGS. 1 and 2, the guide track defines a vertical plane VP that is also a plane of symmetry for the guide track 102. Looking at FIG. 3, the arcuate shape of the guide track 102 defines a plane P102 of the guide track. No matter what angle the guide track makes with a purely vertical direction, the apex may still define the vertical extremity of the guide track 102 in some embodiments such as shown in FIG. 3. This may not be the case in other embodiments.

Focusing now on FIGS. 4-7, the cantilevered umbrella assembly 100 may include a the guide track 102 that defines a first free end 108, a second free end 108', a top surface 134, a bottom surface 136, a first side surface 138 and a second side surface 138' wherein the first side surface 138 defines a first guide slot 140 and the second side surface 138' defines a second guide slot 140'. The carriage assembly 116 may include a slide bracket 142 that includes a first inside side surface 144 and a second inside side surface 144' that are defined by a U-shaped channel. A first roller 146 extends from the first inside side surface 144 that is rotatably attached thereto, and a second roller 146' extends from the second inside side surface 144' that is rotatably attached thereto. The first roller 146 is disposed in the first guide slot 140 and the second roller 146' is disposed in the second guide slot 140. This creates a sliding joint between the carriage assembly 116 and the guide track 102 that has a limited amount of friction. To that end, bearings, lubrication and the like may be implemented to provide free movement of the rollers and the carriage assembly. The slots are shown to have a T-slot configuration but other configurations such as a dovetail configuration could also be used.

Figure 5:
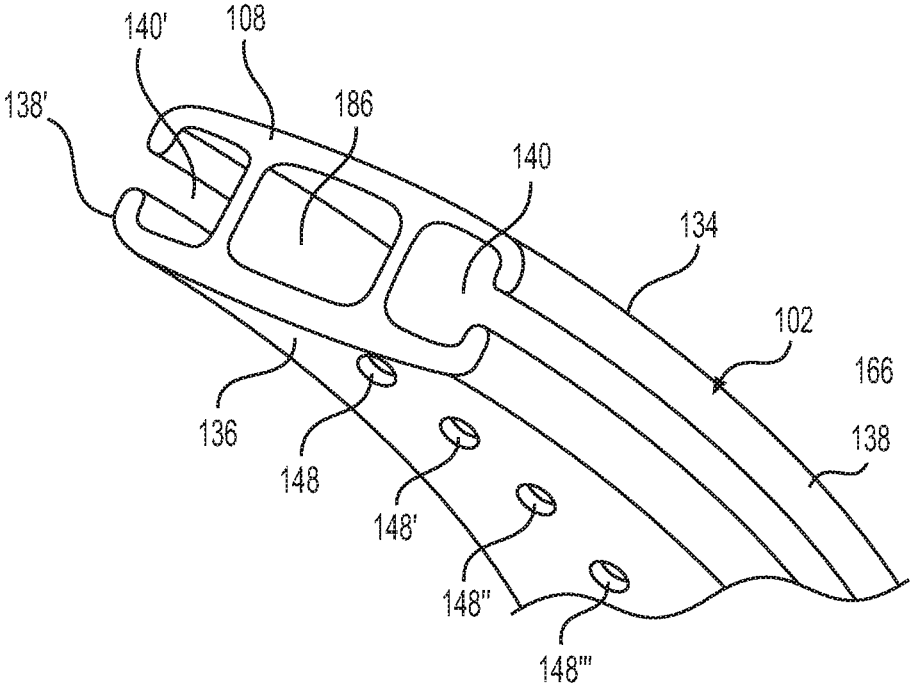
FIG. 5 is a partial bottom oriented perspective view of the guide track of FIG. 4.
Figure 6:
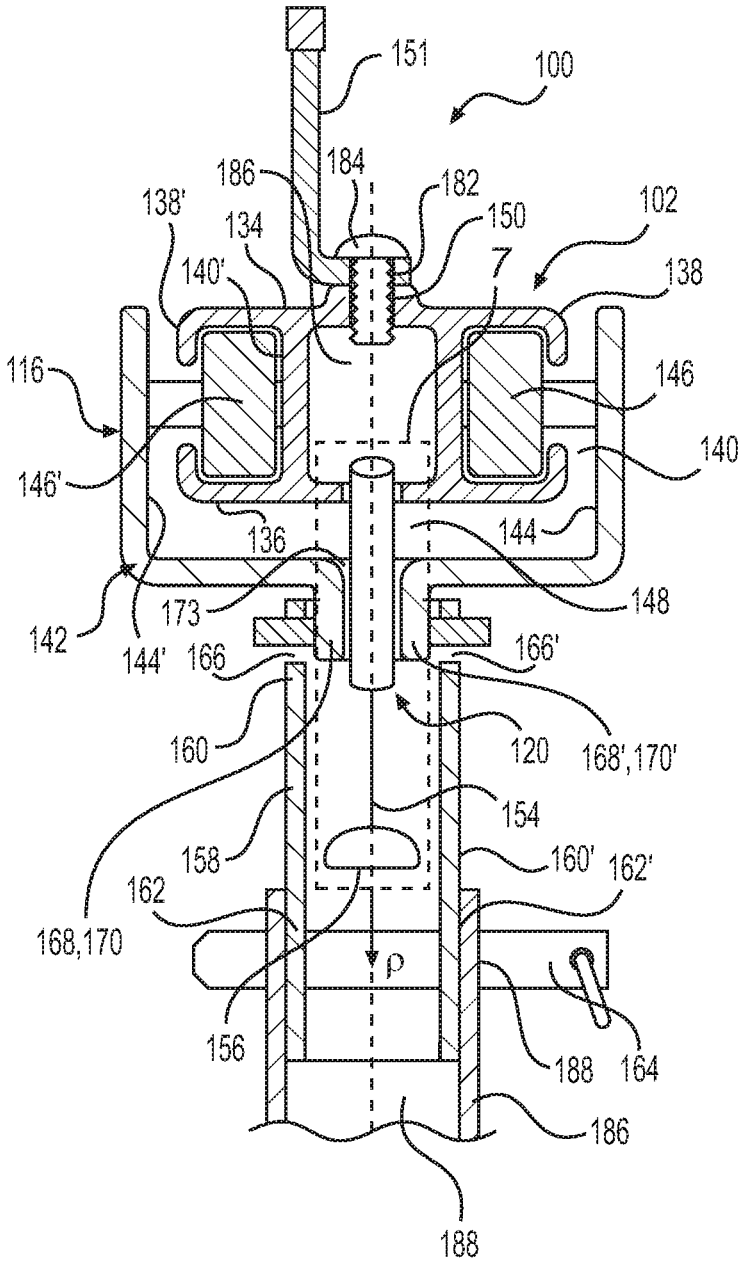
FIG. 6 is a partial cross-sectional view of the umbrella assembly of FIG. 1 taken along lines 6-6 thereof.

As shown in FIGS. 5 and 6, the bottom surface 136 of the guide track 102 defines a plurality of position fixing holes 148 and the top surface 134 of the guide track 102 comprises a plurality of attachment holes 150. The relative position of the position fixing holes 148 may be adjusted as desired but will often be provided at five to ten degree increments so that a suitable amount of adjustability is provided as the sun moves across the sky during the day. Similarly, the relative position of the attachment holes 150 may be adjusted as desired or needed. As will be described in more detail later herein, the attachment holes 150 may be used in conjunction with connecting brackets 151 to attach the guide track 102 to the cantilever arm 106.

Figure 7:
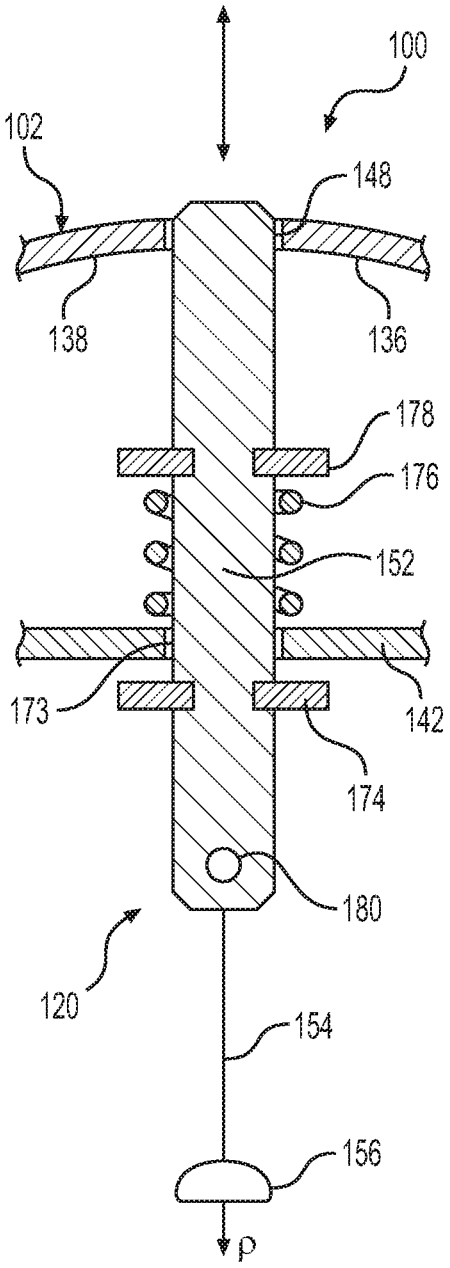
FIG. 7 is an enlarged detailed view taken from FIG. 6 showing more clearly the spring loaded pin of the position fixing mechanism of the carriage assembly.

In FIGS. 6 and 7, it can be understood that the carriage assembly 116 and its position fixing mechanism 120 may include a spring loaded pin 152 that is configured to fit into a position fixing hole 148 of the guide track. The carriage assembly 116 and its position fixing mechanism 120 may further comprise a pull cord 154 and a handle 156 that are attached to the spring loaded pin 152 and that may be used to lock or unlock the mechanism, which in turn, fixes or unfixes the position of the carriage assembly 116 and the umbrella subassembly 122 relative to the guide track 102.

As best seen in FIG. 6, the umbrella attachment mechanism 118 includes an attachment bracket 158 that may be attached to the slide bracket 142. As shown in FIG. 6, the attachment bracket 158 includes at least one member 160 with an aperture 162 and the umbrella attachment mechanism 118 further includes a lanyard pin 164 that is configured to fit within the aperture 162. For the particular embodiment shown in FIG. 6, the attachment bracket 142 may include two members 160 with lower apertures 162 that align allowing the lanyard pin 164 to pass through them. The attachment bracket 158 may have any suitable configuration but may be made from a square shaped channel or C-shaped channel, etc.

The attachment bracket 158 and its two members 160 may also define first and second upper apertures 166 and the carriage assembly 116 includes the slide bracket 142 as previously mentioned. The slide bracket 142 may include two lower members 168 that define third and fourth apertures 170, and the first and second apertures of the attachment bracket 166 are configured to align with the third and fourth apertures 170 of the slide bracket. Again, this siding bracket 142 has a C-shaped configuration but other configurations are possible. The carriage assembly 116 further includes a connecting member 172 that fits within the first, second, third and fourth apertures. The connecting member may take the form of a lanyard pin, a bolt and nut combination, a fastener that mates with threads, etc.

The slide bracket 142 defines an aperture 173 that is configured to be aligned with the position fixing hole 148 of the guide track 102, allowing the spring loaded pin 152 to pass therethrough. Focusing on FIG. 7, it can be seen that the position fixing mechanism 120 may employ a spring loaded pin 152 that is constructed as follows. The pin may have lower washer member 174 that is attached to the pin so that the lower washer member abuts the bottom of the slide bracket 142. A spring 176 may be slid over the upper free end of the pin and then an upper washer member 178 may be slid over the free end and attached to the pin 152. The biasing force of the spring will naturally push against the upper washer member 178 until the upper free end of the pin passes through the position fixing hole 148 of the guide track 102. The lower end of the locking pin 152 includes a hole 180 through which the release cord 154 is threaded and secured. The free end of the cord is attached to a handle 156 that allows for the user to pull onto the handle to lock and unlock the position fixing mechanism 120, allowing the carriage assembly 116 and the umbrella subassembly 122 with its canopy 124 to be moved. Other locking members or mechanisms may be employed.

It is contemplated that the position fixing mechanism may use other constructions such as some type of friction brake or some type of ratcheting pawl mechanism, etc.

Looking now at FIGS. 1 and 6, the connecting brackets 151 define mounting holes 182 that align with the attachment holes 150 of the guide track 102. A fastener 184 is used to hold the guide track 102 onto the connecting brackets 151. As best seen in FIG. 6, the connecting brackets 151 may have L-shaped configurations with the lower horizontal member defining the mounting hole 182 and the upper vertical member being attached (not shown) to the cantilever arm 106 using a fastener, welding, etc. Other configurations and methods of attachment may be used for the connecting brackets.

Returning to FIGS. 4 and 5, the guide track 102 may comprise an extruded member. The material used may include stainless steel, aluminum, plastic or any other suitable material that is sufficiently strong, durable and preferably corrosion resistant. When using the extrusion process, the middle portion 186 of the guide track 102 may be cored out to prevent manufacturing defects related to thick sections when using the extrusion process such as sinks and porosity. Similar materials and manufacturing techniques may be used for many of the other components including the support column, cantilever arm, etc. It is contemplated that the guide track and cantilever arm may be integrally formed using a casting process. Other components may be similarly combined if desired. Furthermore, various components may be fabricated and assembled to create other components, etc. It is further contemplated that the arcuate guide track may be telescopic in nature. In such a case, the first end and/or the second end of the arcuate guide track may be movable.

Returning to FIGS. 1 thru 3, other embodiments of the present disclosure are related to an umbrella subassembly 122 for use with one or all of the cantilevered umbrella assemblies 100 described herein. The umbrella subassembly 122 may be used with other types of umbrella assemblies as well. Various umbrella subassemblies of the present disclosure may be used with an umbrella attachment mechanism 118 having a locking member 164. The subassembly may comprise a canopy 124, an articulated support structure (not shown) to which the canopy is attached, and an upward extending attachment member 186 (see FIG. 6) that defines at least one hole 188 that is configured to receive the locking member 164. The locking member 164 may include a lanyard pin, a nut and bolt combination, etc. The attachment member 186 includes a central channel 188 that is configured to allow a release cord 154 to pass through the subassembly 122. The attachment member 186 may fit around or within the attachment bracket 158 such that its holes align with the holes of the attachment bracket, allowing the lanyard pin 164 to pass through and hold the umbrella subassembly 122 onto the carriage assembly 116.

The construction of the carriage assembly, its connection to the guide rail, as well as its connection to the umbrella subassembly may be such that the slide bracket, attachment bracket, attachment member and canopy remain fixed in orientation relative to the sweep axis of the guide track. That is to say, they remain perpendicular to the sweep axis of the guide rail at all times. This allows the canopy to remain perpendicular to the sun when properly positioned, maximizing the shade provided by the canopy. Accordingly, two sets of roller may be disposed on each side of the guide track and multiple connecting members and lanyard pins may be used to connect the slide bracket to the guide track, the attachment bracket to the slide bracket, and the attachment member to the attachment bracket. In some embodiments, only one lanyard pin may be used to connect the umbrella subassembly to the carriage assembly when the telescoping relationship between the attachment bracket and the attachment member prevent rotation of the umbrella subassembly relative to the carriage assembly. It is contemplated that this feature for optimizing the angular position of the canopy relative to the sun may be omitted in other embodiments.

INDUSTRIAL APPLICABILITY

In practice, any of the cantilevered umbrella assemblies as shown and described herein may be sold, manufactured, or otherwise provided to the user. The entire cantilevered umbrella assembly may be assembled on site or it may be already assembled when shipped from the manufacturer or supplier. In most cases, the cantilevered umbrella assembly is assembled on site and the umbrella subassembly is attached to the carriage assembly as a last step during assembly. It is further contemplated that the umbrella subassembly may be sold or otherwise provided as a replacement part or a substitutable item, giving the user flexibility of the type of canopy that is used.

Figure 8:
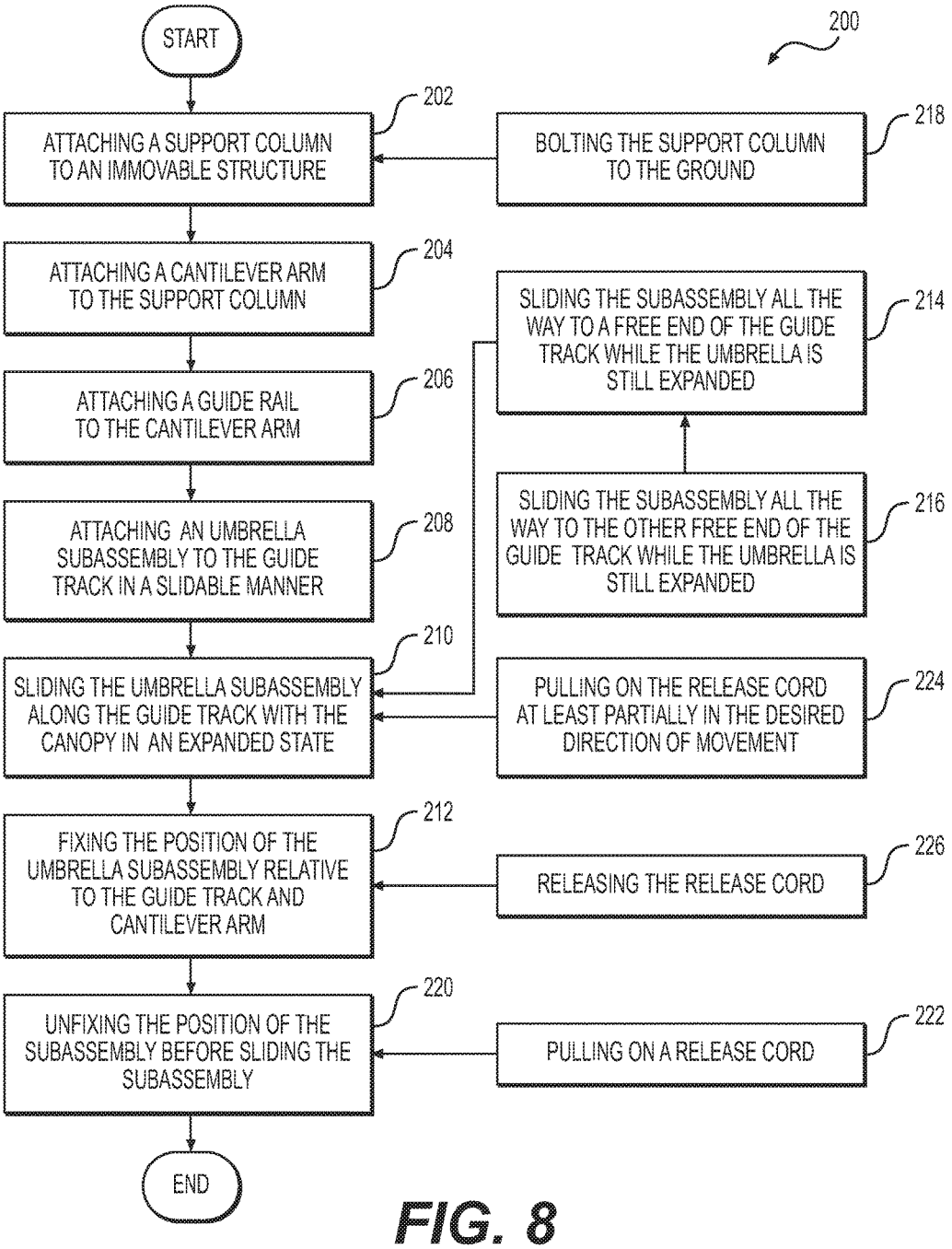
FIG. 8 is a flowchart illustrating a method of assembly and use for various embodiments of the cantilevered umbrella assembly described herein.

FIG. 8 is a flowchart illustrating a method 200 of assembly and use for various embodiments of the cantilevered umbrella assembly described herein. As depicted in FIG. 8, the method may comprise the steps of attaching a support column to an immovable structure (step 202), attaching a cantilever column to the support column (step 204), attaching a guide track to the cantilever column (step 206), attaching an umbrella subassembly to the guide track in a slidable manner (step 208), sliding the umbrella subassembly along or using the guide track with the canopy in an expanded state (step 210), and fixing the position of the umbrella subassembly relative to the guide track and cantilever arm (step 212). The attachment steps may be performed in any suitable order.

In the embodiment shown in FIG. 1, the step of attaching the support column to an immovable structure comprises bolting the support column to the ground (step 218 in FIG. 8). The ground may constitute a concrete surface or the like. In other embodiments, the base of the support column by be attached to a heavy weight such as a bulb of concrete or the like. Any suitable methods or devices may be used provided that enough stability can be maintained even when the canopy is furthest from the support column.

Returning to FIG. 8, the step of sliding the umbrella subassembly may further comprise sliding the subassembly all the way to a free end of the guide track while the umbrella is still expanded (step 214). The step of sliding the umbrella subassembly may further comprise sliding the subassembly all the way to the other free end of the guide track while the umbrella is still expanded (step 216). Furthermore, the method may further comprise unfixing or unlocking the position of the subassembly before sliding the subassembly (step 220). Unfixing the position of the subassembly before sliding the subassembly may include pulling on a release cord (step 222). In some embodiments, sliding the subassembly may include pulling on the release cord at least partially in the desired direction of movement (step 224) and the step of fixing the position of the subassembly may include releasing the release cord (step 226).

Though not shown, the upper portion of the support column may have a slit that runs from the upper free end a suitable distance. This slit may be configured to receive a retaining "T" of the cantilever arm within the hollow portion of the support column. Once fully inserted downwardly into the slot until it is fully seated, the cantilever arm is well secured to the support column except in the upward vertical direction. A top cap (not shown) may then be placed on top of the support column and attached thereto, preventing disassembly of the cantilever arm from the support column. The cantilever arm may be attached to the support column using other methods and devices that are known or that will be devised in the art. Though not shown, end caps or pins may be inserted or attached at or near the free ends of the guide track after the carriage assembly has been installed onto the track, preventing the carriage assembly from falling off the guide track.

It is further contemplated that the cantilever arm and/or the guide track may be integral with the support column. For example, the cantilever arm or the guide track may be welded to the support column and/or the cantilever arm, guide track and support column may have a "T" or "I" beam configuration that may capture the carriage assembly. The guide track may be constructed from bracket or sheet metal components that are welded together or otherwise attached to each other, etc.

The cantilever arm may be machined out of a single piece of material, assembled from individual components, integrally cast, etc. The brackets described herein may be formed from sheet metal using a metal forming or bending process. Other components that have enclosed perimeters such as channels may be made from tube stock, channel stock, and the like. Other components may be custom made or commercially bought, etc.

Looking at FIGS. 1 and 3, one skilled in the art can appreciate that by pulling on the release cord at an angle to the vertical direction (see force vector p), both horizontal and vertical components of force are exerted on the release cord. The vertical component of the force will unlock the carriage assembly while the horizontal component will move the carriage assembly and the umbrella subassembly in the desired direction. This may continue until the desired position for the umbrella subassembly is achieved. Then, the user may release the cord and the spring force will bias the locking member/pin into the position fixing hole of the guide track.

As shown in FIG. 1, the release cord may pass completely through the carriage assembly and the umbrella subassembly below the canopy for easy user access. In some embodiments such as depicted in FIG. 6, the release cord and handle are not easily accessed. This may be desirable when only official personnel at a venue are meant to access the release cord and adjust the position of the canopy. In such a case, a cover (not shown) may be used to hide the handle to prevent access. The cover may be attached using a padlock or the like. In other cases, a cover may be omitted and access to the handle will merely require the use of a ladder or stepstool, etc.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the disclosure(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A cantilevered umbrella assembly with an arcuate guide track comprising:

a support column;

a cantilever arm attached to the support column; and an at least partially arcuate configured guide track attached to the cantilever arm that defines a sweep axis and a plane, wherein the guide track defines a first end, a second end, an apex between the first end and the second end along the sweep axis, and a guide slot that extends from first end to the second end;

and wherein the sweep axis defines a first tangent to the sweep axis at the first end, a second tangent at the second end, and a third tangent at the apex, wherein a first line drawn perpendicularly to the first tangent and a second line drawn perpendicularly to the third tangent form an included angle in the plane of the guide track that ranges from 10 to 45 degrees.

2. The cantilevered umbrella assembly of claim 1 wherein the included angle ranges from about 25 to 35 degrees.

3. The cantilevered umbrella assembly of claim 1 wherein the support column defines a side surface and the cantilever arm extends from the side surface of the support column.

4. The cantilevered umbrella assembly of claim 3 wherein the cantilever arm forms an inverted "L" shape with the support column and the apex of the guide track defines the vertical extremity of the guide track.

5. The cantilevered umbrella assembly of claim 1 wherein a third line drawn perpendicularly from the second tangent forms a second included angle with the line drawn from the second tangent, wherein the first and second included angles are within 5 degrees of each other.

6. The cantilevered umbrella assembly of claim 1 further comprising a carriage assembly that is slidably attached to the guide track and that includes an umbrella attachment mechanism and a position fixing mechanism.

7. A cantilevered umbrella assembly with an arcuate guide track comprising:

a support column;

a cantilever arm attached to the support column;

an at least partially arcuate configured guide track attached to the cantilever arm that remains at least selectively fixed in position relative to the support column and the cantilever arm, the guide track defining a first free end and a second free end and a sweep axis that extends from the first free end to the second free end; and an umbrella subassembly that is translatably attached to the guide track and is configured to slide from the first end of the guide track to the second end of the guide track in an expanded state without collapsing.

8. The cantilevered umbrella assembly of claim 7 further comprising a carriage assembly that is slidably attached to the guide track and that includes an umbrella attachment mechanism and a position fixing mechanism, wherein the umbrella subassembly is attached to the carriage assembly via the umbrella attachment mechanism and the umbrella attachment mechanism and the carriage assembly are configured to remain perpendicular to the sweep axis when translating along the guide track.

9. The cantilevered umbrella assembly of claim 8 wherein the umbrella subassembly includes an expansion and collapsing mechanism for the umbrella separate from the fixing mechanism of the carriage assembly.

10. The cantilevered umbrella assembly of claim 9 wherein the guide track defines a vertical apex between the first end and the second end and a sweep axis therebetween; and wherein the sweep axis defines a first tangent to the sweep axis at the first end, a second tangent at the second end, and a third tangent at the apex, wherein a first line drawn perpendicularly to the first tangent and a second line drawn perpendicularly to the third tangent forms an included angle in the plane of the guide track that ranges from 10 to 45 degrees.

11. The cantilevered umbrella assembly of claim 10 wherein the guide track defines a vertical plane that is also a plane of symmetry for the guide track.

12. A cantilevered umbrella assembly with a guide track comprising:

a support column;

a cantilever arm attached to the support column;

a guide track attached to the cantilever arm that remains at least selectively fixed in position relative to the support column and the cantilever arm, the guide track defining a first free end, a second free end, a top surface, a bottom surface, a first side surface and a second side surface wherein the first side surface defines a first guide slot and the second side surface defines a second guide slot; and a carriage assembly the includes a slide bracket that includes a first inside side surface and a second inside side surface, a first roller extending from the first inside side surface that is rotatably attached thereto, and a second roller extending from the second inside side surface that is rotatably attached thereto, wherein the first roller is disposed in the first guide slot and the second roller is disposed in the second guide slot.

13. The cantilevered umbrella assembly of claim 12 wherein the bottom surface of the guide track defines a plurality of position fixing holes and the top surface of the guide track comprises a plurality of attachment holes.

14. The cantilevered umbrella of claim 13 wherein the carriage assembly further comprises a position fixing mechanism that includes a spring loaded pin that is configured to fit into a position fixing hole of the guide track.

15. The cantilevered umbrella assembly of claim 14 wherein the carriage assembly further comprises a pull cord and a handle that are attached to the spring loaded pin.

16. The cantilevered umbrella assembly of claim 15 wherein the slide bracket defines an aperture that is configured to be aligned with the position fixing hole of the guide track, allowing the spring loaded pin to pass therethrough.

17. The cantilevered umbrella assembly of claim 13 further comprising connecting brackets that are attached to the cantilever arm that define mounting holes that align with the attachment holes of the guide track.

18. The cantilevered umbrella assembly of claim 12 wherein the carriage assembly further comprises an umbrella attachment mechanism that includes an attachment bracket that is attached to the slide bracket, wherein the attachment bracket includes at least one member with an aperture, the umbrella attachment mechanism further including a lanyard pin that is configured to fit within the aperture.

19. The cantilevered umbrella assembly of claim 18 wherein the attachment bracket includes two members that define the first and second apertures and the slide bracket includes two members that define third and fourth apertures, wherein the first and second apertures of the attachment bracket are configured to align with the third and fourth apertures of the slide bracket, and the carriage assembly further includes a connecting member that fits within the first, second, third and fourth apertures.

20. The cantilevered umbrella assembly of claim 12 wherein the guide track comprises an extruded member.

21. A method of assembling and using an umbrella assembly comprising:

attaching a support column to an immovable structure;

attaching a cantilever arm to the support column;

attaching a guide track to the cantilever arm;

attaching an umbrella subassembly to the guide track in a slidable manner;

sliding the umbrella subassembly along or using the guide track with the canopy in an expanded state along an arcuate path; and fixing the position of the umbrella subassembly relative to the guide track and cantilever arm.

22. The method of claim 21 wherein the step of attaching the support column to an immovable structure comprises bolting the support column to the ground.

23. The method of claim 21 wherein sliding the umbrella subassembly includes sliding the subassembly all the way to a free end of the guide track while the umbrella is still expanded.

24. The method of claim 23 further comprising sliding the subassembly all the way to the other free end of the guide track while the umbrella is still expanded.

25. The method of claim 21 further comprising unfixing the position of the subassembly before sliding the subassembly.

26. The method of claim 25 wherein unfixing the position of the subassembly before sliding the subassembly includes pulling on a release cord.

27. The method of claim 26 wherein sliding the subassembly includes pulling on the release cord at least partially in the desired direction of movement and fixing the position of the subassembly includes releasing the release cord.

* * * * *